US010695784B2

(12) United States Patent
Fritz et al.

(10) Patent No.: US 10,695,784 B2
(45) Date of Patent: Jun. 30, 2020

(54) COATING APPARATUS HAVING AN INTERCEPTING DEVICE

(71) Applicant: Dürr Systems AG, Bietigheim-Bissingen (DE)

(72) Inventors: Hans-Georg Fritz, Ostfildern (DE); Benjamin Wöhr, Eibensbach/Güglingen (DE); Marcus Kleiner, Besigheim (DE); Moritz Bubek, Ludwigsburg (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 31 days.

(21) Appl. No.: 15/775,037

(22) PCT Filed: Nov. 16, 2016

(86) PCT No.: PCT/EP2016/001911
§ 371 (c)(1),
(2) Date: May 10, 2018

(87) PCT Pub. No.: WO2017/084753
PCT Pub. Date: May 26, 2017

(65) Prior Publication Data

US 2018/0333733 A1 Nov. 22, 2018

(30) Foreign Application Priority Data

Nov. 20, 2015 (DE) ..... 10 2015 015 092

(51) Int. Cl.
*B05B 14/00* (2018.01)
*B05B 12/22* (2018.01)
*B05B 12/34* (2018.01)

(52) U.S. Cl.
CPC ..... *B05B 14/00* (2018.02); *B05B 12/22* (2018.02); *B05B 12/34* (2018.02)

(58) Field of Classification Search
None
See application file for complete search history.

(56) References Cited

U.S. PATENT DOCUMENTS 3,570,275 A 3/1971 Weber et al.
4,144,837 A 3/1979 Johnston
(Continued)

FOREIGN PATENT DOCUMENTS

DE 699 02 317 T2 3/2003
DE 10 2007 020287 A1 11/2008
(Continued)

OTHER PUBLICATIONS

International Search Report and Written Opinion for PCT/EP2016/001911 dated Feb. 2, 2017 (12 pages; with English translation).
(Continued)

*Primary Examiner* — Binu Thomas
(74) *Attorney, Agent, or Firm* — Bejin Bieneman PLC

(57) ABSTRACT

A coating apparatus for coating a component with a coating agent includes an applicator for delivering at least one coating agent jet of the coating agent to the component. The coating apparatus includes an intercepting device which in an active position intercepts the at least one coating agent jet between the applicator and the component so that the at least one coating agent jet does not strike the component.

39 Claims, 8 Drawing Sheets

(56) References Cited

U.S. PATENT DOCUMENTS

| | | | | |
|---|---|---|---|---|
| 4,254,433 | A | 3/1981 | Dewar, Jr. | |
| 4,783,977 | A | 11/1988 | Gilpatrick | |
| 5,175,018 | A | 12/1992 | Lee | |
| 5,670,202 | A * | 9/1997 | Guzowski | B05B 14/00 427/8 |
| 6,085,654 | A * | 7/2000 | Gunschera | B05B 14/10 101/424.2 |
| 6,266,835 | B1 * | 7/2001 | Henry | D06B 11/0023 68/205 R |
| 6,451,117 | B1 | 9/2002 | Farquhar | |
| 6,709,516 | B1 | 3/2004 | Vaehakuopus et al. | |
| 7,157,122 | B2 | 1/2007 | Strebe | |
| 7,279,045 | B2 | 10/2007 | Strebe | |
| 9,643,194 | B2 | 5/2017 | Wohr et al. | |
| 9,744,560 | B2 | 8/2017 | Fritz | |
| 2001/0036512 | A1 | 11/2001 | Ito et al. | |
| 2007/0227000 | A1 * | 10/2007 | Burton | C23C 4/12 29/888.4 |
| 2010/0183815 | A1 | 7/2010 | Marx et al. | |
| 2011/0220014 | A1 * | 9/2011 | Haas | B05B 7/1468 118/46 |
| 2012/0219699 | A1 | 8/2012 | Pettersson et al. | |
| 2013/0071573 | A1 * | 3/2013 | Brewer | B05B 12/22 427/421.1 |
| 2013/0257984 | A1 | 10/2013 | Beier et al. | |
| 2014/0205744 | A1 | 7/2014 | McNutt | |
| 2014/0329013 | A1 | 11/2014 | Rouaud | |
| 2015/0086723 | A1 | 3/2015 | Bustgens | |
| 2015/0147460 | A1 | 5/2015 | Manzi | |
| 2015/0375239 | A1 | 12/2015 | Herre et al. | |
| 2015/0375241 | A1 | 12/2015 | Wohr et al. | |
| 2015/0375258 | A1 | 12/2015 | Fritz et al. | |
| 2016/0001322 | A1 | 1/2016 | Fritz et al. | |
| 2017/0136481 | A1 | 5/2017 | Fritz et al. | |
| 2017/0203324 | A1 | 7/2017 | Wohr et al. | |
| 2017/0354985 | A1 * | 12/2017 | Jimenez Ramos | B05B 12/22 |

FOREIGN PATENT DOCUMENTS

| | | | |
|---|---|---|---|
| DE | 10 2010 019612 | A1 | 11/2011 |
| DE | 10 2012 005650 | A1 | 9/2013 |
| DE | 10 2013 002 411 | A1 | 8/2014 |
| DE | 10 2013 002 412 | A1 | 8/2014 |
| DE | 10 2013 002 413 | A1 | 8/2014 |
| DE | 10 2013 002 433 | A1 | 8/2014 |
| EP | 2208541 | A2 | 7/2010 |
| EP | 2644392 | A2 | 10/2013 |
| FR | 2673857 | A1 | 9/1992 |
| GB | 1253099 | A | 11/1971 |
| JP | S5724663 | A | 2/1982 |
| WO | 0037739 | A1 | 6/2000 |
| WO | 03066950 | A2 | 8/2003 |

OTHER PUBLICATIONS

International Search Report and Written Opinion for PCT/EP2016/001899 dated Feb. 13, 2017 (14 pages; with English translation).

Non-Final Office Action dated Dec. 17, 2018 on U.S. Appl. No. 15/755,121 (22 pages).

* cited by examiner

COATING APPARATUS HAVING AN INTERCEPTING DEVICE

CROSS-REFERENCE TO RELATED APPLICATIONS

This application is a national stage of, and claims priority to, Patent Cooperation Treaty Application No. PCT/EP2016/001911, filed on Nov. 16, 2016, which application claims priority to German Application No. DE 10 2015 015 092.8, filed on Nov. 20, 2015, which applications are hereby incorporated herein by reference in their entireties.

BACKGROUND

The disclosure relates to a coating apparatus for coating a component with a coating agent, in particular for painting a motor vehicle body component or an aviation component with a paint. The disclosure relates further to a corresponding coating process.

There are known from the prior art (e.g. DE 10 2013 002 433 A1, DE 10 2013 002 413 A1, DE 10 2013 002 412 A1, DE 10 2013 002 411 A1) application devices and application processes which deliver at least one narrowly limited coating agent jet and therefore permit sharply contoured coating or painting. This sharply contoured coating applied without a mask that is described in the prior art does not produce any paint or coating agent losses due to overspray. Such resource-efficient methods are advantageous for a large number of applications, such as, for example, coating processes.

Sharply contoured coating or painting is also advantageous in particular in the case of contrast painting of motor vehicles, when different surface regions of the motor vehicle body are to be painted with different colours. Sharply contoured painting with the above-mentioned application devices and methods makes it possible to dispense with masking of the surface regions of the motor vehicle body that are not to be painted, as is conventionally necessary in the case of contrast painting using rotary atomisers.

However, when the above-mentioned application devices and methods are used, the coating result is often unacceptable because splashes of the coating agent can form on the component surface at the start and end of the delivery of the coating agent.

[TB1]

Accordingly, the object underlying the disclosure is to provide a correspondingly improved coating apparatus and a correspondingly improved coating process.

FIG. 1A is a schematic representation of a coating installation according to the disclosure with an intercepting device in the inactive state, FIG. 1B shows the coating installation of FIG. 1A with the intercepting device in the active state, FIG. 2 shows a modification of FIG. 1A with an intercepting device having two cutters on the same side of the coating agent jet, FIG. 3 shows a modification of an intercepting device having two opposing cutters which are moved together, FIG. 4 shows a modification with two cutters which are situated one behind the other in the jet direction, FIG. 5 is a schematic representation of a cutter with a specific blade angle and a specific cutting angle, FIG. 6 is a schematic representation of a cutting edge of a cutter with a specific wedge angle and a specific blade angle, FIG. 7 shows a modification of the preceding embodiments having an applicator which delivers a plurality of coating agent jets, FIG. 8 is a schematic representation to illustrate the directions of movement of the applicator and the cutter relative to one another, FIG. 9 shows a modification of FIG. 8 with a parallel direction of movement of the applicator and the cutter, FIG. 10A shows a modification with a pivotable cutter in the active position, FIG. 10B shows a modification of FIG. 10A with the pivotable cutter in the inactive position, and FIG. 11 shows a modification of the embodiment of FIGS. 10A and 10B wherein the pivotable cutter in the inactive position assists with the removal by suction.

DETAILED DESCRIPTION

The disclosure is based on the newly acquired technical-physical finding that the splashes on the component surface are caused by unsteady conditions when the coating agent jet is switched on and switched off. When the coating agent jet is switched on, it takes some time for the coating agent jet to assume its steady state. Immediately after a switch-on process, the coating agent jet is thus still unsteady, which can lead to troublesome splashes when it strikes the component surface. Similar unsteady conditions also occur when the coating agent jet is switched off, so that the coating agent jet is unsteady immediately before the end of coating, which again can lead to an unsatisfactory coating result.

The disclosure therefore includes the general technical teaching not to use the coating agent jet that is unsteady as a result of switching processes for coating the component. Although the unsteady states of the coating agent jet on switching on and switching off cannot be prevented, because this is unavoidable, it is nevertheless possible to discard the coating agent jet if it is still unsteady as a result of switching processes. Within the scope of the disclosure, the coating agent jet is thus used for coating only during steady states, whereas the coating agent jet is not used for coating during unsteady conditions at the time of switching on and switching off.

The coating apparatus according to the disclosure first has, in conformity with the prior art, an applicator which delivers a coating agent jet of the coating agent to the component. The applicator can be configured and function, for example, as described in patent applications DE 10 2013 002 433 A1 (corresponding to US 2016/0001,322 A1), DE 10 2013 002 413 A1 (corresponding to US 2015/0375,241 A1), DE 10 2013 002 412 A1 (corresponding to US 2015/0375,258 A1) and DE 10 2013 002 411 A1 (corresponding to US 2015/0375,239 A1) cited at the beginning. However, it should be mentioned that the coating agent jet is preferably a spatially narrowly limited jet of droplets or a spatially limited cohesive jet.

The coating apparatus according to the disclosure is distinguished by an intercepting device which in an active position intercepts the coating agent jet between the applicator and the component so that the coating agent jet does not strike the component. The intercepting device thus allows the coating agent jet to be intercepted when it is still in an unsteady state, such as, for example, during switching on or switching off. The intercepting device can thereby prevent the coating agent jet in the unsteady state from striking the component, since this could lead in the worst case to undesirable splashes on the component surface.

The intercepting device is preferably displaceable between the active position already mentioned and an inactive position, the intercepting device in the inactive position allowing the coating agent jet to pass so that the coating agent jet is then able to strike the component unhindered.

When the coating agent jet is in the settled, steady state, the intercepting device is thus moved into the inactive position so that the steady coating agent jet is then able to strike the component surface unhindered.

On the other hand, when the coating agent jet is in the unsteady state (e.g. immediately after a switching process), the intercepting device is moved into the active position and then intercepts the unsteady coating agent jet so that it cannot strike the component.

The movement of the intercepting device between the active position and the inactive position can be a purely linear movement, for example. However, it is also possible within the scope of the disclosure that the movement of the intercepting device between the active position and the inactive position is a purely rotational movement. Moreover, the movement of the intercepting device may also be a pivoting movement. It is further also possible that the movement of the intercepting device between the active position and the inactive position is a combined translational, pivoting and/or rotational movement.

In the case of a rotational movement of the intercepting device between the active position and the inactive position, the axis of rotation is preferably oriented parallel to the coating agent jet and/or at a right angle to the surface of the component to be coated. In the case of a rotational movement, the intercepting device (shutter) is preferably mounted on a rotatable unit and can follow the twisting of the applicator.

In the case of a pivoting movement of the intercepting device between the active position and the inactive position, the pivoting movement takes place about a pivot axis which is preferably oriented at a right angle to the coating agent jet and/or parallel to the surface of the component to be coated.

In a preferred embodiment of the disclosure, the coating apparatus also comprises at least one actuator for moving the intercepting device between the active position and the inactive position. The actuator can have an electric motor, for example, for displacing the intercepting device. However, it is also possible that the actuator operates pneumatically or hydraulically. It is further also possible that the actuator operates electromagnetically. It should generally be mentioned that the disclosure is not limited to the examples mentioned above in respect of the driving principle of the actuator.

The direction of movement of the intercepting device can correspond to the direction of movement of the applicator and/or be opposed thereto.

In another form, the direction of movement of the intercepting device can be angled at an angle of 0°-180°, in particular 30°-150°, especially 45°-135°, to the direction of movement of the applicator and/or to the direction of the at least one jet.

It is advantageous within the scope of the disclosure if the intercepting device can be moved as quickly as possible between the inactive position and the active position in order to achieve a quick response behaviour of the intercepting device. The maximum displacement speed of the actuator is therefore preferably substantially greater than the exit speed of the coating agent jet from the applicator or the flow speed in the coating agent jet. For example, the maximum displacement speed of the actuator can be greater by a factor of 1, 2, 5, 10, 25 or even 50 than the exit speed or the flow speed of the coating agent jet. Such a rapid response of the intercepting device is advantageous because the coating agent jet can then quickly be cut off or released.

For changing between the active position and the inactive position, the intercepting device thus requires a short changeover time, which is relatively small in relation to the exit speed from the applicator. Moreover, this changeover time is also small in absolute terms. The changeover time between the active position and the inactive position is preferably less than 500 ms, 250 ms, 100 ms, 50 ms, 25 ms, 10 ms, 5 ms, 2 ms or 1 ms.

The intercepting device additionally preferably has at least one outlet for discharging the intercepted coating agent through the outlet when the intercepting device is in the active position. This is expedient in order that the intercepted coating agent does not reach the component surface.

This discharging of the intercepted coating agent through the outlet can be assisted by connecting at least one suction device to the outlet of the intercepting device for removing by suction through the outlet the coating agent intercepted by the intercepting device. This suction device can generate a low pressure in the outlet, for example, in order to remove by suction the intercepted coating agent.

In the preferred embodiment of the disclosure, the intercepting device operates with at least one cutter for cutting off the coating agent jet in the active position. The cutter preferably has a cutting edge which extends transversely (e.g. at a right angle) to the coating agent jet. The cutter is preferably movable relative to the coating agent jet between the active position and the inactive position, in particular in a displacement direction at a right angle to the cutting edge and at a right angle to the coating agent jet.

It should be mentioned here that the cutter has a cutter face facing the coating agent jet which encloses a specific cutting angle with the coating agent jet which can be, for example, in the range of 45°-90°, 70°-90° or 80°-90°.

The cutting edge of the cutter, on the other hand, has a wedge angle which can be in the range of 10°-90°, 25°-80° or 45°-60°.

It should further be mentioned that the cutter can have a blade angle which can be in the range of, for example, 2°-25°, 5°-30° or 10°-25°.

With regard to the cutter, it should also be mentioned that the cutter can be coated with a wetting-inhibiting or wetting-promoting coating in order to allow the drops which may form on the cutting edge during the cutting operation either to run off in the cutting direction or to collect on the side facing the jet in the cutting direction.

In a variant of the disclosure, the intercepting device has at least two cutters which are both movable between the inactive position and the active position, it being possible for the cutting edges of the two cutters to be arranged parallel to one another.

It should be mentioned here that the cutters can be arranged either on the same side or on opposite sides of the coating agent jet.

It should additionally be mentioned that the cutters are either movable independently of one another or connected mechanically to one another so that the cutters are then moved synchronously together.

It should further be noted in relation to the cutters that the cutters can enclose with their cutting surface facing the coating agent jet either the same cutting angle or different cutting angles with the coating agent jet.

Moreover, the cutters can be movable either in opposite directions or in the same direction in relation to the coating agent jet.

With regard to the axial position of the cutters in relation to the coating agent jet, it should be noted that the cutters can be arranged either in the same axial position or in different axial positions in relation to the coating agent jet.

Finally, it should be noted in connection with the cutters that the cutters can either be fixed in a removable manner to the intercepting device or formed in one piece on the intercepting device.

In an example of the disclosure, the intercepting device has an intercepting region for collecting the coating agent, this intercepting region preferably tapering towards the outlet in the manner of a funnel. The intercepting region is preferably situated on the side of the cutter remote from the coating agent jet.

If the intercepting device has at least two cutters on the same side, an additional intercepting region for the coating agent with an outlet is advantageously provided between the cutters.

The cutting edge can be straight (linear) like a razor blade, but it may also have a convex or concave, or bent, shape. In a particular form, it has the shape of a triangle.

In the case of a pivoting movement of the cutter between the active position and the inactive position, the cutter can also serve to close the intercepting region at least partly in the inactive position. This is advantageous if the intercepted coating agent is removed by suction from the intercepting region by means of a suction device, as has already been described briefly above. Closing the intercepting region at least partly by the cutter increases the low pressure used for the removal by suction, which makes the removal by suction more effective.

However, the pivotable cutter, in one example, should not close the intercepting region completely even in the inactive position. Rather, the pivotable cutter, in some examples, should leave a small gap open even in the inactive position, so that coating agent can be drawn from the outside through the gap into the intercepting region through the gap.

The intercepting device can additionally have a fluid feed line for introducing a fluid into the intercepting device, such as, for example, a flushing agent, a solvent or a diluent or air. The introduction of such a fluid can assist and facilitate the removal of the intercepted coating agent through the outlet.

The introduction of the fluid into the intercepting region can take place via at least one nozzle, at least one slot or via a porous structure.

With regard to the coating agent, it should be mentioned that it can be, for example, a paint, an adhesive, a sealant or an insulating material. However, the disclosure is not limited in respect of the type of coating agent to these examples of coating agents.

With regard to the applicator, it should be mentioned that it is preferably an applicator as described in patent applications DE 10 2013 002 433 A1 (corresponding to US 2016/0001,322 1), DE 10 2013 002 413 A1 (corresponding to US 2015/0375,241 A1), DE 10 2013 002 412 A1 (corresponding to 2015/0375,258 A1) and DE 10 2013 002 411 A1 (corresponding to US 2015/0375,239 A1) cited at the beginning, so that the content of those patent applications is to be incorporated in its entirety into the present description in respect of the construction and operation of the applicator. However, it is in principle also possible that the applicator is a conventional atomiser, such as, for example, a rotary atomiser or an applicator for highly viscous media.

It should further be noted that the disclosure is particularly suitable for the coating of body components (e.g. motor vehicle body components), attached parts for motor vehicles or components of the aviation industry. However, the disclosure is not limited in respect of the type of component to be coated to these types of component.

It should additionally be noted that the applicator is guided over the component preferably by a multi-axis coating robot, in particular by a coating robot with serial kinematics. Such coating robots are known per se from the prior art and therefore do not have to be described in greater detail. The applicator can, however, also be guided over the component by a different single- or multi-axis movement device.

It should further be mentioned that the disclosure not only claims protection for a coating apparatus. Rather, the disclosure also claims protection for a coating process, as is already apparent from the preceding description.

It should be mentioned here that a specific sequence of activation of the intercepting device and the applicator may be observed for the switching processes of the coating agent jet.

In the case of a switch-on process of the coating agent jet, the intercepting device may be only deactivated once the unsteady conditions following switching on of the coating agent jet have subsided, so that the coating agent jet is only released by the intercepting device and strikes the component surface once the unsteady conditions following switching on have subsided.

When the coating agent jet is switched off, the coating agent jet may be only switched off once the intercepting device has been activated, so that the unsteady switch-off conditions of the coating agent jet can no longer impair the coating result.

The details of the above-mentioned switching processes are also described in the applicant's parallel German patent application entitled "Coating method and corresponding coating installation", which was filed at the same time. The content of this parallel German patent application is therefore to be incorporated in its entirety into the present application.

FIGS. 1A and 1B show a coating apparatus according to the disclosure having an applicator 1 which delivers a cohesive coating agent jet 2 to a component 3.

The applicator 1 can be, for example, an application device as described in patent applications DE 10 2013 002 433 A1 (corresponding to US 2016/0001,322 A1), DE 10 2013 002 413 A1 (corresponding to US 2015/0375,241 A1), DE 10 2013 002 412 A1 (corresponding to US 2015/0375,258 A1) and DE 10 2013 002 411 A1 (corresponding to US 2015/0375,239 A1) cited at the beginning, so that the content of those patent applications is to be incorporated in its entirety into the present description in respect of the construction and operation of the applicator 1.

The component 3 can be, for example, a motor vehicle body component which is to be painted with contrast painting, that is to say with different colours. However, the disclosure is not limited in respect of the type of component 3 to motor vehicle body components.

The coating agent jet 2 is here spatially narrowly limited and can be switched on and switched off by the applicator 1, which permits sharply contoured painting.

However, during a switch-on process and a switch-off process, unsteady transitional conditions occur, which impair the suitability of the coating agent jet 2 for coating since splashes can occur on the component 3 if the coating agent jet 2 in the unsteady state after a switching process strikes the component 3.

The coating apparatus according to the disclosure therefore prevents the coating agent jet 2 from striking the component 3 when it is in an unsteady state after a switching process. For this purpose, the coating apparatus according to the disclosure has an intercepting device for intercepting the coating agent jet 2 when it still exhibits unsteady transitional states. This intercepting device is movable between an inactive position according to FIG. 1A and an active position according to FIG. 1B.

In the inactive position according to FIG. 1A, the intercepting device allows the coating agent jet 2 to pass unhindered, so that the coating agent jet 2 is then able to strike the component 3.

In the active position according to FIG. 1B, on the other hand, the intercepting device intercepts the coating agent jet 2 and thereby prevents the coating agent jet 2 from striking the component 3.

For this purpose, the intercepting device has a cutter 4 which is movable by an actuator 5 in the direction indicated by the double arrow. In the active position according to FIG. 1B, the cutter 4 has moved into the longitudinal axis of the coating agent jet 2 and thereby cuts off the coating agent jet 2 before it strikes the component. The intercepted coating agent jet then first passes into a funnel-shaped intercepting region 6 in the intercepting device and is then removed by suction by a suction device 9 via an outlet 7 and a discharge line 8.

A fluid supply 10 additionally opens into the intercepting region 6 of the intercepting device, which fluid supply is fed with a fluid from a fluid source 12 via a fluid feed line 11. The fluid source 12 thus guides a fluid into the intercepting region 6 via the fluid feed line 11 and the fluid supply 10, whereby the discharge of the coating agent through the outlet 7 is facilitated.

FIG. 2 shows a modification of the example in FIGS. 1A and 1B so that, in order to avoid repetition, reference is made to the preceding description, the same reference numerals being used for corresponding details.

A particular feature of this example is that, instead of the cutter 4 according to FIGS. 1A and 1B, two cutters 4.1, 4.2 are provided. The two cutters 4.1, 4.2 are here arranged on the same side of the coating agent jet 2 and are moved together by the actuator 5.

FIG. 3 shows a modification of the example according to FIG. 2 so that, in order to avoid repetition, reference is made to the preceding description.

A particular feature of this example is that the two cutters 4.1, 4.2 are arranged on opposite sides of the coating agent jet 2. Accordingly, two intercepting regions 6.1, 6.2, two fluid supplies 10.1, 10.2, two fluid feed lines 11.1, 11.2, two outlets 7.1, 7.2 and two suction lines 8.1, 8.2 are provided.

FIG. 4 shows a further modification of the example according to FIG. 2 so that, in order to avoid repetition, reference is made to the preceding description, the same reference numerals being used for corresponding details.

A particular feature of this example is first that the cutter 4.1 encloses a cutting angle $\alpha 1$ with the coating agent jet, while the other cutter 4.2 encloses a cutting angle $\alpha 2$ with the coating agent jet 2. The two cutting angles $\alpha l$, $\alpha 2$ are not shown equal here, but in a further advantageous form they may also be equal.

A further particular feature of this example is that each of the two cutters 4.1, 4.2 feeds its own separate funnel-shaped intercepting region 6.1 or 6.2.

FIGS. 5 and 6 show schematic representations to illustrate different angles of the cutter 4.

Firstly, FIG. 5 shows the cutting angle $\alpha$ between the coating agent jet 2 and a side face 13 of the cutter 4 facing the coating agent jet 2.

Secondly, FIG. 5 shows a blade angle E between the side face 13 of the cutter 4 facing the coating agent jet 2 and an opposing side face 14.

FIGS. 5 and 6 further show a cutting edge 15 of the cutter 4, the cutting edge 15 extending at a right angle to the coating agent jet 2.

FIG. 6 further shows a wedge angle $\beta$ of the cutting edge 5.

FIG. 7 shows a modification of an applicator 1 according to the disclosure which delivers a plurality of coating agent jets 2 from a plurality of nozzles 6. The nozzles 16 are here arranged in a line along an applicator nozzle axis $r_D$. The coating agent jets 2, on the other hand, are oriented parallel to one another in a direction $v_B$.

FIG. 8 shows, on the one hand, that the applicator nozzle axis $r_D$ is oriented at a right angle to the direction $v_B$ of the coating agent jets 2.

FIG. 8 further shows as vectors $v_A$ the direction of movement of the cutter 4 and as a vector $v_S$ the direction of movement of the cutter 4. It is clear from this representation that the direction of movement $v_A$ of the applicator 1 is at an angle relative to the direction of movement $v_S$ of the cutter 4.

Figure 1A:
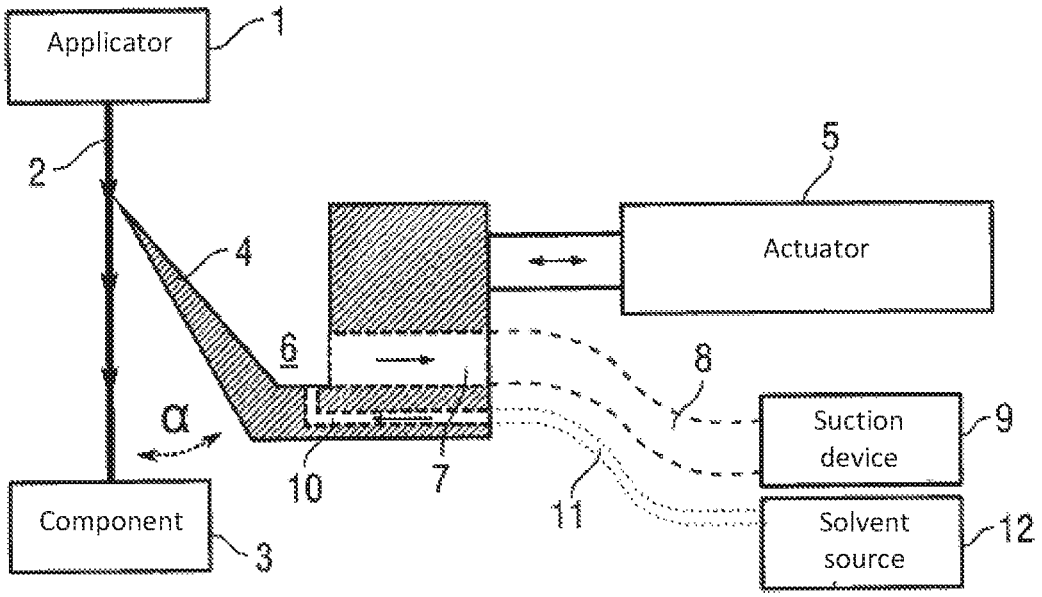
Figure 1B:
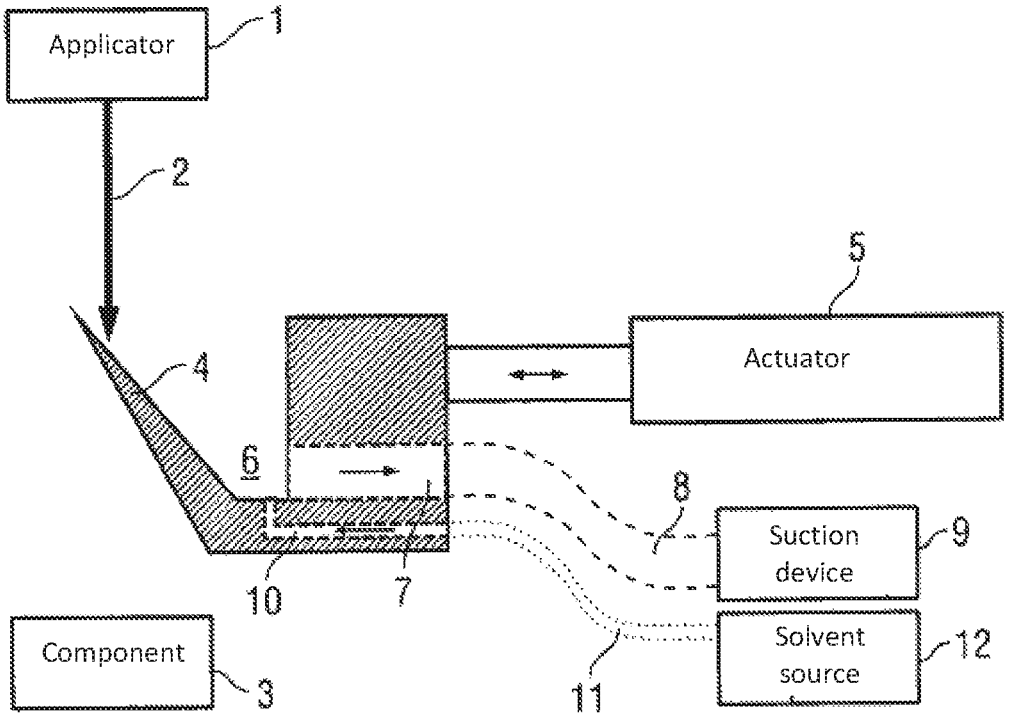
Figure 2:
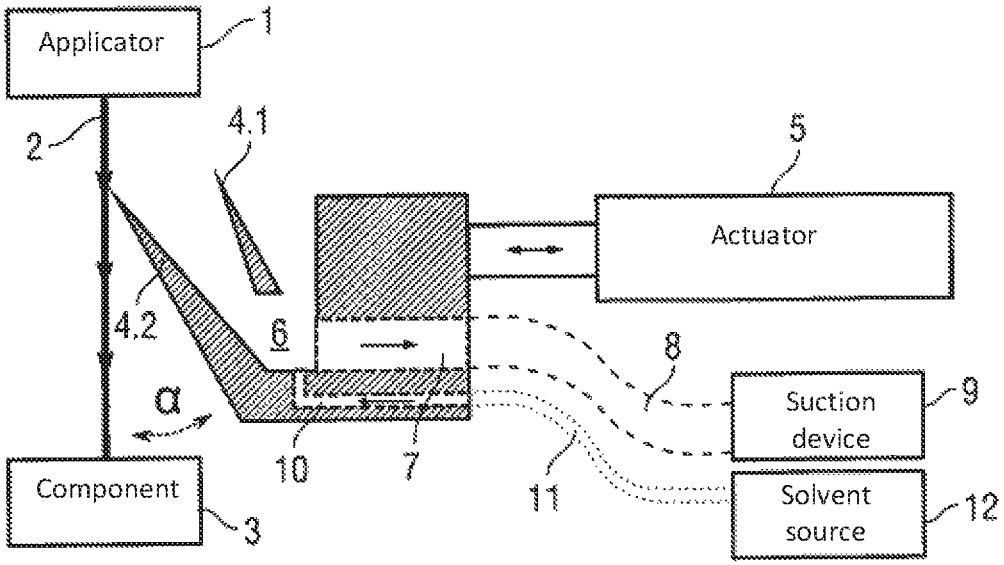
Figure 3:
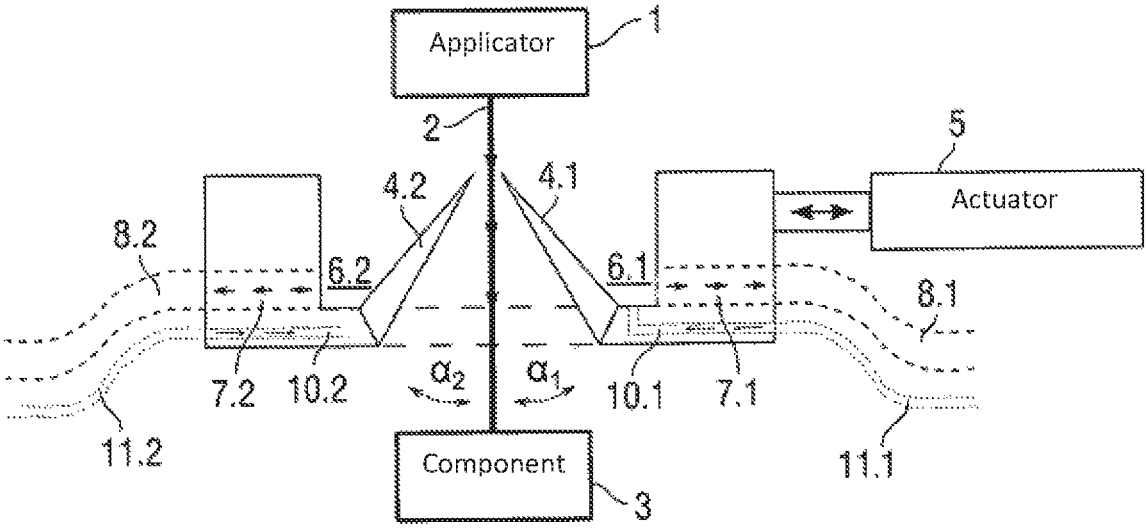
Figure 4:
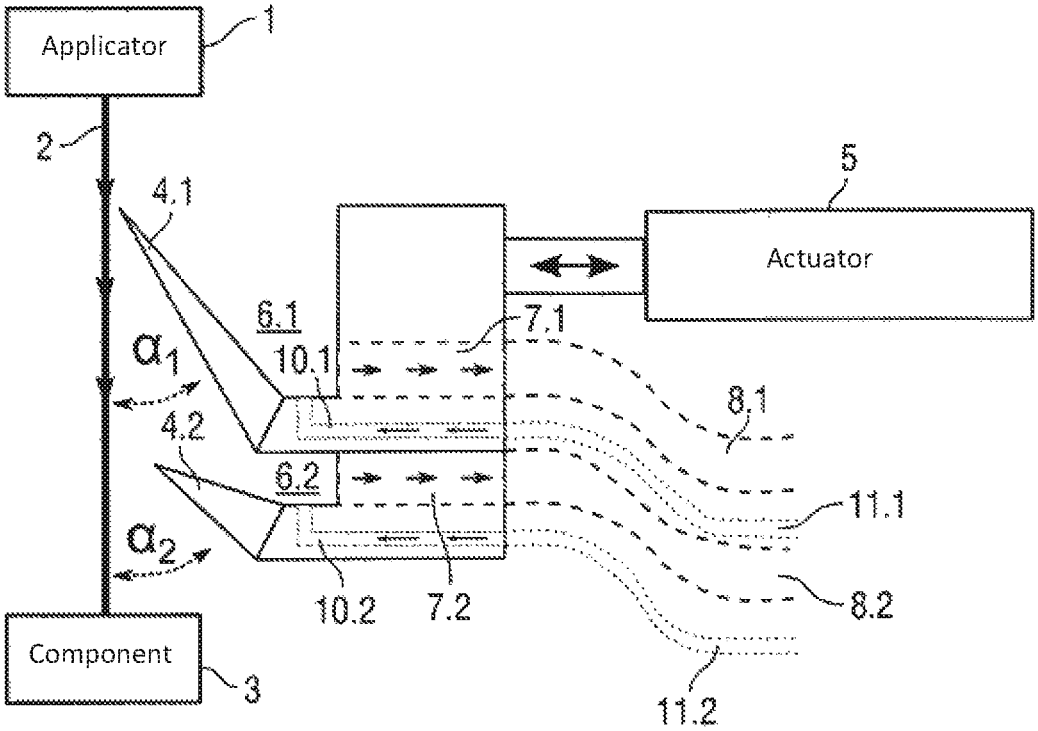
Figure 5:
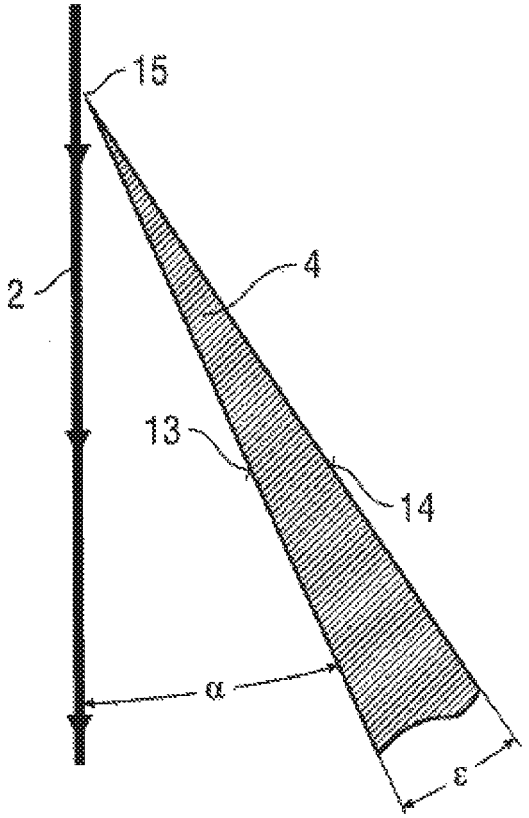
Figure 6:
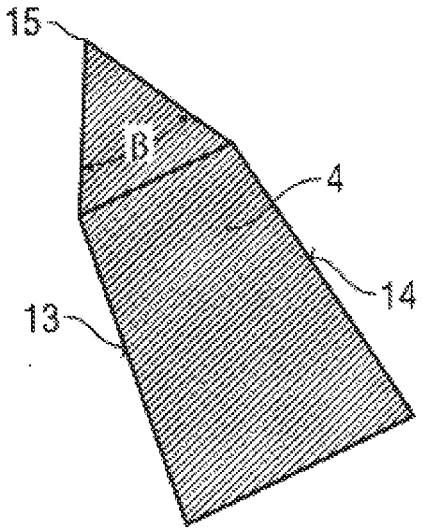
Figure 7:
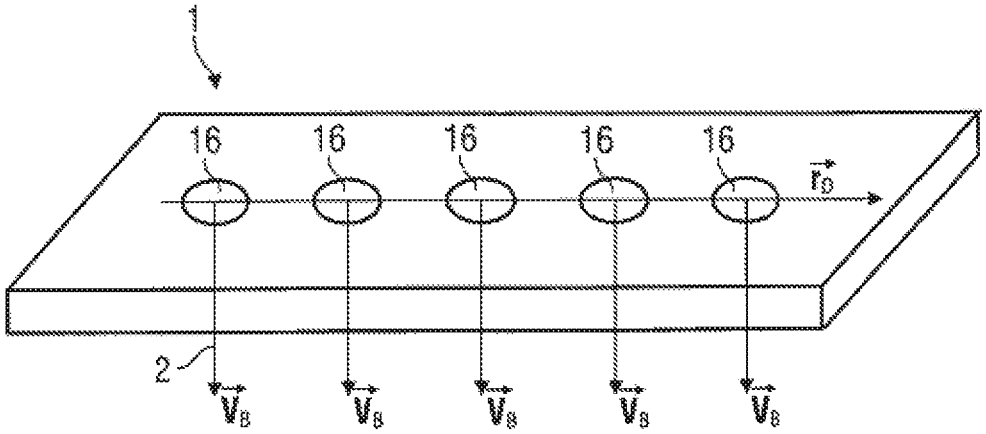
Figure 8:
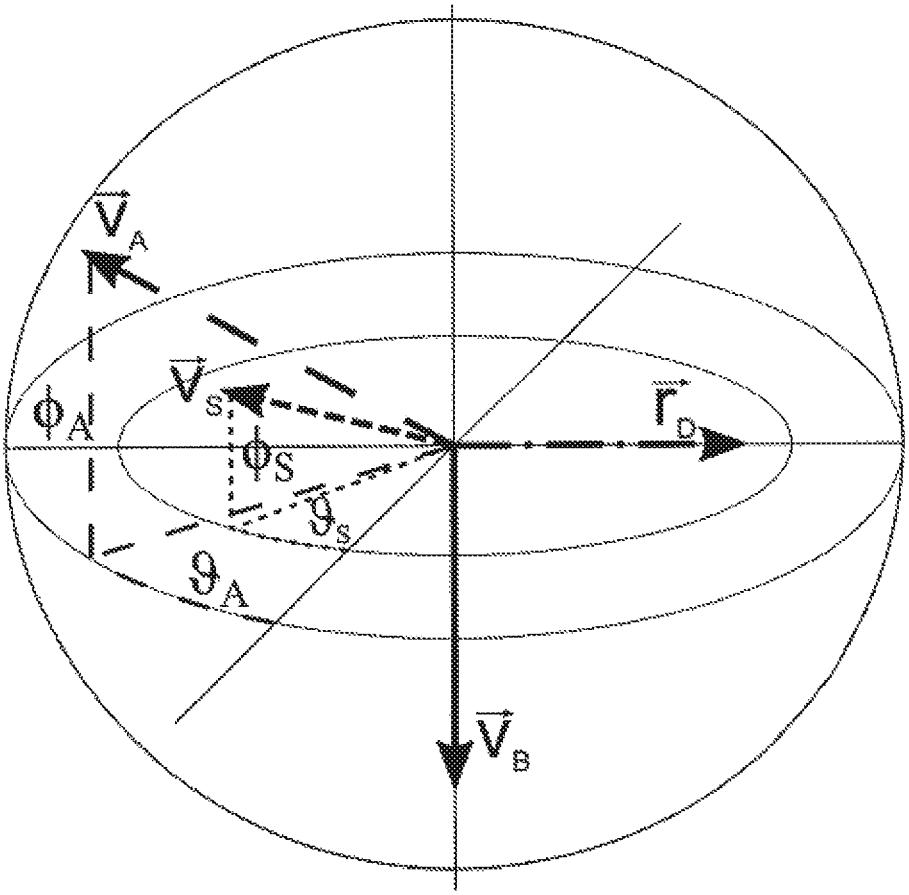
Figure 9:
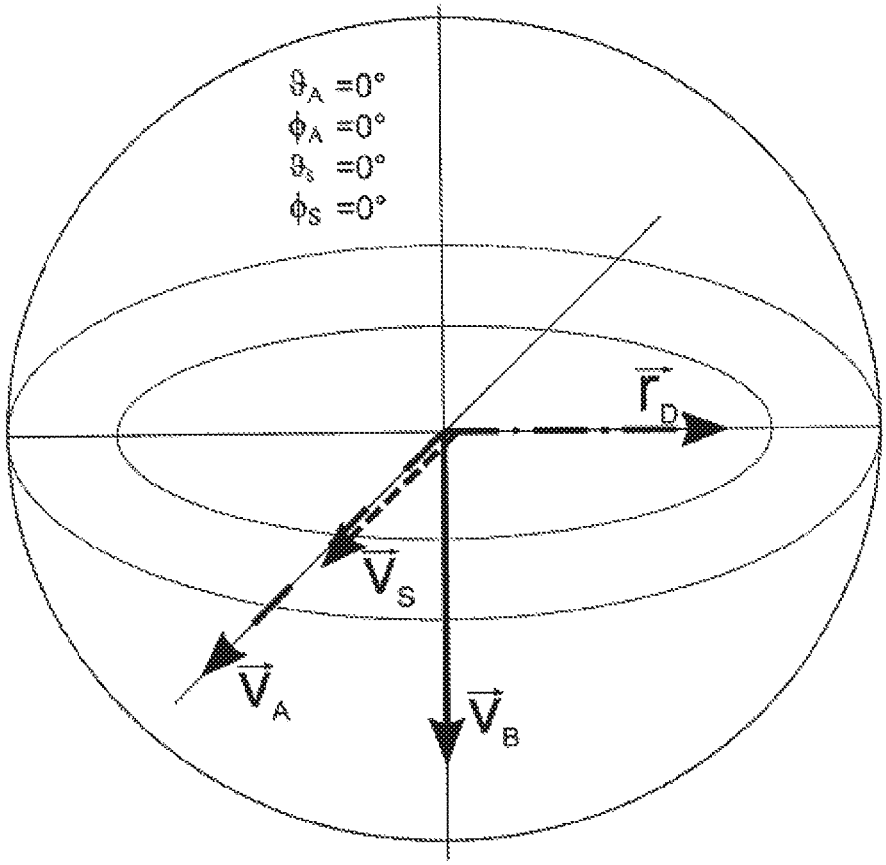
FIG. 9 shows a modification of FIG. 8, this modification showing a special case in which the direction of movement $v_S$ of the cutter 4 is oriented parallel to the direction of movement $v_A$ of the applicator 1.
Figure 10A:
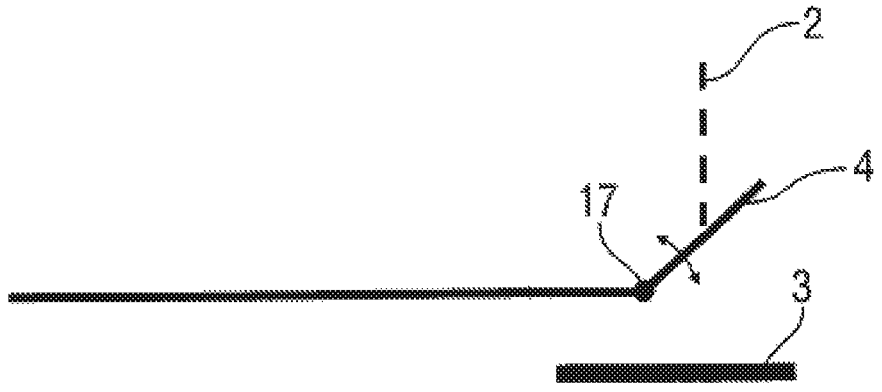
FIGS. 10A and 10B show a modification of the preceding examples so that, in order to avoid repetition, reference is made to the preceding description, the same reference numerals being used for corresponding details.
Figure 10B:
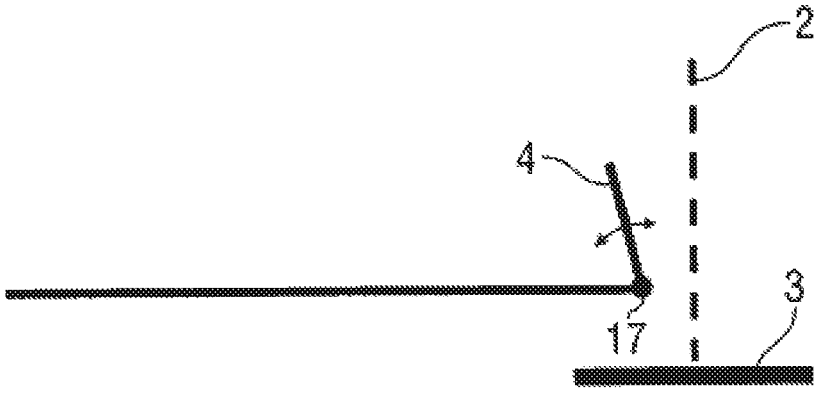

A particular feature of this example is that the cutter 4 can be pivoted in the direction indicated by the double arrow about a pivot axis 17 between an active position (FIG. 10A) and an inactive position (FIG. 10B).

The pivot axis 17 is oriented at a right angle to the coating agent jet 2 and parallel to the surface of the component 3 to be coated, that is to say the pivot axis 17 extends at a right angle to the plane of the drawing in FIGS. 10A and 10B.

Figure 11:
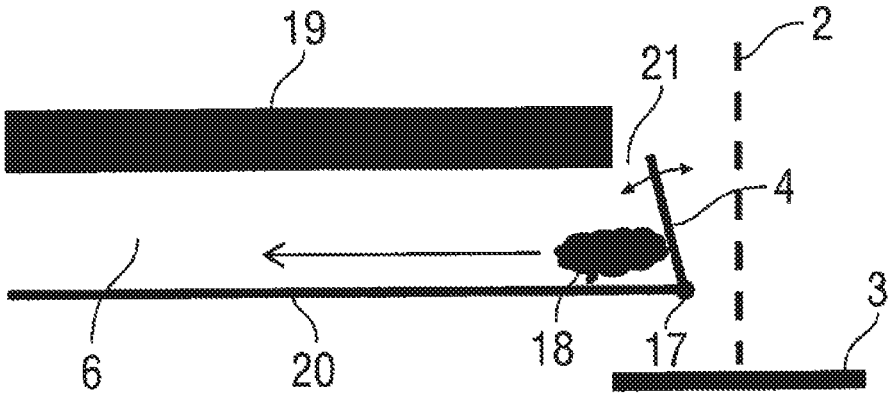

FIG. 11 shows a modification of the embodiment according to FIGS. 10A and 10B so that, in order to avoid repetition, reference is made to the preceding description, the same reference numerals being used for corresponding details.

A particular feature of this example is that the intercepting region 6 is connected to a suction device which is able to generate a low pressure in the intercepting region 6 in order to be able to remove coating agent residues 18 by suction.

The intercepting region is limited on its upper side by a shutter lid 19 and on its lower side by a base 20. The intercepting region 6 thus forms a suction channel between the shutter lid 19 and the base 20.

The drawing here shows the inactive position of the cutter 6, in which the coating agent jet 2 is not intercepted but is allowed to pass to the component 3. In this position, the cutter 6 partly closes the front opening of the suction channel between the shutter lid 19 and the base 20 apart from a narrow gap 21. This increases the low pressure in the intercepting region 6 during removal of the coating agent residues 18 by suction.

However, the gap 21 that remains open then allows coating agent residues to be drawn into the intercepting region 6 from the outside through the gap 21 that remains open.

The disclosure is not limited to the preferred embodiments described above. Rather, the disclosure also includes a large number of variants and modifications which likewise make use of the inventive concept and therefore fall within the scope of protection. In particular, the disclosure also claims protection for the subject matter and the features of the dependent claims, independently of the claims on which they are each dependent and in particular also without the features of the main claim.

LIST OF REFERENCE NUMERALS

1 Applicator
2 Coating agent jet
3 Component
4 Cutter
4.1, 4.2 Cutters
5 Actuator for displacing the cutter
6 Funnel-shaped intercepting region
6.1, 6.2 Funnel-shaped intercepting region
7 Outlet
7.1, 7.2 Outlet
8 Suction line
8.1, 8.2 Suction line
9 Suction device
10 Fluid supply in the intercepting device
10.1, 10.2 Fluid supply in the intercepting device
11 Fluid feed line
11.1, 11.2 Fluid feed line
12 Fluid source
13 Side face of the cutter
14 Side face of the cutter
15 Cutting edge
16 Nozzles
17 Pivot axis in the case of pivoting of the cutter
18 Coating agent residues
19 Shutter lid
20 Base of the intercepting region
21 Gap
$\alpha$ Cutting angle
$\beta$ Wedge angle
$\varepsilon$ Blade angle
$r_D$ Applicator nozzle axis
$v_B$ Direction of the coating agent jet
$v_A$ Direction of movement of the applicator
$v_S$ Direction of movement of the cutter

The invention claimed is:

1. A coating apparatus for coating a component with a coating agent, said coating apparatus comprising:
a) an applicator for delivering at least one coating agent jet of the coating agent to the component,
b) further comprising an intercepting device which in an active position intercepts the at least one coating agent jet between the applicator and the component so that the at least one coating agent jet does not strike the component, the intercepting device has a fluid feed line for introducing a fluid into the intercepting device, the fluid feed line opens into an intercepting region, the fluid feed line is fed from a fluid source.

2. The coating apparatus according to claim 1, wherein the intercepting device is displaceable between the active position and an inactive position, the intercepting device in the inactive position allowing the coating material jet to pass so that the coating material jet is then able to strike the component unhindered.

3. The coating apparatus according to claim 2, wherein the intercepting device is linearly displaceable between the active position and the inactive position.

4. The coating apparatus according to claim 2, wherein the intercepting device is pivotable between the active position and the inactive position.

5. The coating apparatus according to claim 2, wherein the intercepting device is rotatable between the active position and the inactive position.

6. The coating apparatus according to claim 5, wherein for displacement between the active position and the inactive position, the intercepting device performs a rotational movement about an axis of rotation which is oriented substantially parallel to the coating agent jet.

7. The coating apparatus according to claim 4, wherein, for displacement between the active position and the inactive position, the intercepting device performs a pivoting movement about a pivot axis which is oriented substantially at a right angle to the coating agent jet and/or parallel to a surface of the component to be coated.

8. The coating apparatus according to claim 2, further comprising an actuator for moving the intercepting device between the active position and the inactive position.

9. The coating apparatus according to claim 8, wherein
a) the coating agent jet leaves the applicator with a specific exit speed,
b) the actuator moves the intercepting device with a specific maximum displacement speed, and
c) the maximum displacement speed of the actuator is greater than the exit speed of the coating agent jet.

10. The coating apparatus according to claim 2, wherein the intercepting device has an outlet for discharging the intercepted coating agent through the outlet when the intercepting device is in the active position.

11. The coating apparatus according to claim 10, wherein a suction device is connected to the outlet of the intercepting device for removing by suction through the outlet the coating agent intercepted by the intercepting device.

12. The coating apparatus according to claim 2, wherein
a) the intercepting device has at least one cutter for cutting off the coating agent jet in the active position, and
b) the cutter has a cutting edge which extends transversely to the coating agent jet, and
c) the cutter is movable relative to the coating agent jet between the active position and the inactive position.

13. The coating apparatus according to claim 12, wherein the cutter is movable between the active position and the inactive position as a linear movement in a displacement direction at a right angle to the cutting edge and at a right angle to the coating agent jet.

14. The coating apparatus according to claim 12, wherein the cutter is movable between the active position and the inactive position as a pivoting movement about a pivot axis which is oriented at a right angle to the coating agent jet and/or parallel to the surface of the component to be coated.

15. The coating apparatus according to claim 12, wherein the cutting edge of the cutter has a wedge angle which is in the range 10°-90°.

16. The coating apparatus according to claim 12, wherein the cutter has a blade angle which is in the range of 2°-45°.

17. The coating apparatus according to claim 12, wherein the cutter is at least partly coated with a wetting-inhibiting or wetting-promoting coating.

18. The coating apparatus according to claim 2, wherein
a) the intercepting device has at least two cutters, and
b) the cutters are movable relative to the coating agent jet between the inactive position and the active position, and
c) the cutting edges of the cutters are arranged parallel to one another.

19. The coating apparatus according to claim 18, wherein the cutters are arranged on opposite sides of the coating agent jet.

20. The coating apparatus according to claim 18, wherein the cutters are connected together mechanically so that the cutters are moved synchronously together.

21. The coating apparatus according to claim 18, wherein the cutters are movable independently of one another.

22. The coating apparatus according to claim 18, wherein the cutters each have a cutter face facing the coating agent jet that enclose a same cutting angle with the coating agent jet.

23. The coating apparatus according to claim 18, wherein the cutters each have a cutter face that enclose different cutting angles with the coating agent jet.

24. The coating apparatus according to claim 18, wherein the cutters, in relation to the coating agent jet are movable in opposite directions.

25. The coating apparatus according to claim 18, wherein the cutters are movable in the same direction.

26. The coating apparatus according to claim 18, wherein the cutters, in relation to the coating agent jet are arranged in the same axial position.

27. The coating apparatus according to claim 18, wherein the cutters in relation to the coating agent jet are arranged in different axial positions.

28. The coating apparatus according to claim 18, wherein the cutters are fixed in a removable manner to the intercepting device.

29. The coating apparatus according to claim 18, wherein the cutters are fixed in one piece on the intercepting device.

30. The coating apparatus according to claim 1, wherein the intercepting device has an intercepting region for collecting the coating agent.

31. The coating apparatus according to claim 30, wherein the intercepting region narrows towards the outlet in the manner of a funnel.

32. The coating apparatus according to claim 30, wherein the intercepting region is situated on a side of a cutter remote from the coating agent jet.

33. The coating apparatus according to claim 1, wherein the introduction of the fluid into the intercepting region takes place via at least one nozzle or at least one slot or via a porous structure.

34. The coating apparatus according to claim 1, wherein a) the coating agent is selected from a group consisting of a paint, an adhesive, a sealant and an insulating material, and b) the applicator is selected from a group consisting of an atomiser, an applicator applying a stream of droplets of the coating agent, an applicator applying the coating agent jet as a cohesive coating agent jet, and c) the component to be coated is selected from a group consisting of a motor vehicle body component, an attached part for a motor vehicle, and an aviation component, and d) the applicator is guided over the component by a multi-axis coating robot with serial kinematics.

35. The coating apparatus according to claim 1, wherein the applicator delivers a plurality of coating agent jets parallel to one another.

36. A coating apparatus for coating a component with a coating agent, said coating apparatus comprising:

a) an applicator for delivering at least one coating agent jet of the coating agent to the component, b) further comprising an intercepting device which in an active position intercepts the at least one coating agent jet between the applicator and the component so that the at least one coating agent jet does not strike the component, the intercepting device has at least two cutters, the cutters are movable relative to the coating agent jet between the inactive position and the active position, the cutting edges of the cutters are arranged parallel to one another, and the cutters are arranged on the same side of the coating agent jet.

37. A coating apparatus for coating a component with a coating agent, said coating apparatus comprising:

a) an applicator for delivering at least one coating agent jet of the coating agent to the component, b) further comprising an intercepting device which in an active position intercepts the at least one coating agent jet between the applicator and the component so that the at least one coating agent jet does not strike the component, the intercepting device having an intercepting region for collecting the coating agent, and wherein a pivotable cutter of the intercepting device, in the inactive position, at least partly closes the intercepting region from which coating agent is removable by suction, in order to increase the low pressure generated in the intercepting region during removal by suction.

38. The coating apparatus according to claim 37, wherein the pivotable cutter of the intercepting device does not close the intercepting region completely even in the inactive position but leaves a gap open so that coating agent residues is drawable into the intercepting region from the outside through the gap.

39. A coating apparatus for coating a component with a coating agent, said coating apparatus comprising:

a) an applicator for delivering at least one coating agent jet of the coating agent to the component, b) further comprising an intercepting device which in an active position intercepts the at least one coating agent jet between the applicator and the component so that the at least one coating agent jet does not strike the component, the intercepting device is displaceable between the active position and an inactive position, the intercepting device in the inactive position allowing the coating material jet to pass so that the coating material jet is able to strike the component unhindered, the intercepting device has at least one cutter for cutting off the coating agent jet in the active position, the cutter has a cutting edge which extends transversely to the coating agent jet, the cutter is movable relative to the coating agent jet between the active position and the inactive position, and the cutter has a cutter face facing the coating agent jet which encloses a cutting angle of not more than 90° and at least 45° with the coating agent jet.

* * * * *